United States Patent [19]

Yonker et al.

[11] 4,294,315

[45] Oct. 13, 1981

[54] LANDING NIPPLE

[75] Inventors: John H. Yonker; Ernest P. Fisher, Jr., both of Carrollton, Tex.; David Bills, Baldrack, England

[73] Assignee: Otis Engineering Corporation, Dallas, Tex.

[21] Appl. No.: 960,169

[22] Filed: Nov. 13, 1978

[51] Int. Cl.[3] ..... E21B 43/12; F16K 3/00

[52] U.S. Cl. ..... 166/322; 166/154; 166/242

[58] Field of Search ..... 166/316–324, 166/154, 242

[56] References Cited

U.S. PATENT DOCUMENTS

| | | | |
|---|---|---|---|
| 3,796,257 | 3/1974 | Hudson | 166/322 |
| 3,874,634 | 4/1975 | Gazada | 251/319 |
| 4,026,362 | 5/1977 | Mott | 166/322 |
| 4,044,835 | 8/1977 | Mott | 166/322 |

*Primary Examiner*—James A. Leppin
*Attorney, Agent, or Firm*—Vinson & Elkins

[57] ABSTRACT

A landing nipple, adaptable to be made up in a tubing string having a sliding sleeve disposed in its bore for selectively providing communication of balance and control pressure fluid to the nipple bore. When the sleeve is shifted to its first, upper position, balance fluid is conducted via the nipple to a tubing retrievable safety valve placed in the tubing string below the nipple. In the event the tubing retrievable safety valve is taken out of service, a secondary safety valve can be landed in the nipple, the sleeve shifted to its downward, second position, opening sleeve ports for conducting control and balance fluids to the landed, secondary safety valve. The nipple has a failed closed safety system provided by the novel arrangement of nipple entry ports for balance and control fluid, in that the control fluid entry port is in between two balance fluid ports and their seals, so that failure of the pressure seal exposed to tubing pressure causes tubing pressure to enter the balance pressure system closing the tubing retrievable or secondary safety valve, whichever is presently in service.

12 Claims, 6 Drawing Figures

LANDING NIPPLE

BACKGROUND OF THE INVENTION

1. Field of the Invention

The invention relates to an improved landing nipple for use in a tubing string for receiving and housing a flow control device. More particularly, the landing nipple has a provision for closure of the flow control device in the event of seal failure in the nipple.

2. The Prior Art

It is common to provide landing nipples, for being made up in a tubing string, having a "dual line" control system for operating flow control devices landed in the nipple. Such landing nipples provide for the transmission of pressure fluid to the nipple, with the control pressure fluid generally being used to open the flow control device to allow passage of well fluids to the surface.

Modern flow control devices sometimes have "balance" pressure chambers for off-setting the hydrostatic pressure generated by the column of fluid in the control line. Thus, the "dual line" provides essentially equal hydrostatic pressure to assist in closing the flow control device.

In order to isolate the control and balance pressure zones, of a dual line landing nipple, from tubing bore pressure, seals are arranged on each side of the pressure zone. It is possible in such arrangements for tubing bore pressure to get around such seals and enter the control pressure line. If the tubing bore pressure is greater than the hydrostatic pressure in the balance line plus the flow of the closing spring, the flow control device can "fail" in the bore-open position. Thus, a potentially dangerous situation has been created.

A dual line landing nipple for receiving a remote controlled tubing safety valve is illustrated on page 4001 of the *Composite Catalog of Oil Field Equipment and Services* (1974-75). While the landing nipple illustrated therein is for use with wire line equipment, those used for pump down services are virtually identical in operation. Pump down services for well production and completion is discussed in the *Composite Catalog,* supra, commencing on page 4070.

The drawings in this application illustrate use of the nipple of this invention with pump down flow control devices. Such pump down equipment is referred to as "through the flow line" or TFL equipment. However, the invention is applicable to both TFL and wire-line equipment.

Objects of the Invention

An object of the invention is to provie a back-up safety system for a flow control device made up in the tubing string of a well.

Another object is to provide a landing nipple, adapted to be made up in a tubing string, which in the event of seal failure, will cause the tubing retrievable or secondary safety valve to close.

Another object is to provide a well landing nipple having control and balance pressure means preferably extending from the well surface with the control pressure being guarded from well pressure by the balance pressure.

Still a further object is to provide a well landing nipple made up in the well tubing string above a primary flow control device, whereby a secondary flow control device can be landed in the nipple in the event the primary flow control device fails.

SUMMARY OF THE INVENTION

A landing nipple adapted to be made up in a tubing string comprising:

a tubulr member having a bore extending axially therethrough adapted for receiving a flow control device in said bore, said tubular member having exterior means for receiving balance and control pressure fluids and means for communicating said fluids from said exterior to the interior thereof, said means for communicating the control pressure fluid being separated from well fluid pressure, conducted through said tubing string, by said means for communicating balance pressure fluid and seals therebetween, and additional seal means between said balance pressure fluid communicating means and said well fluid pressure conducted through said tubing string, whereby failure of said additional seal means causes said well fluid pressure to invade said balance pressure fluid communicating means rather than said control pressure communicating means.

DESCRIPTION OF THE DRAWINGS

These and other objects, advantages and features of the present invention will become more apparent upon consideration of the following specification, taken in connection with the accompanying drawing, wherein.

DESCRIPTION OF THE PREFERRED EMBODIMENT

Figure 1A:
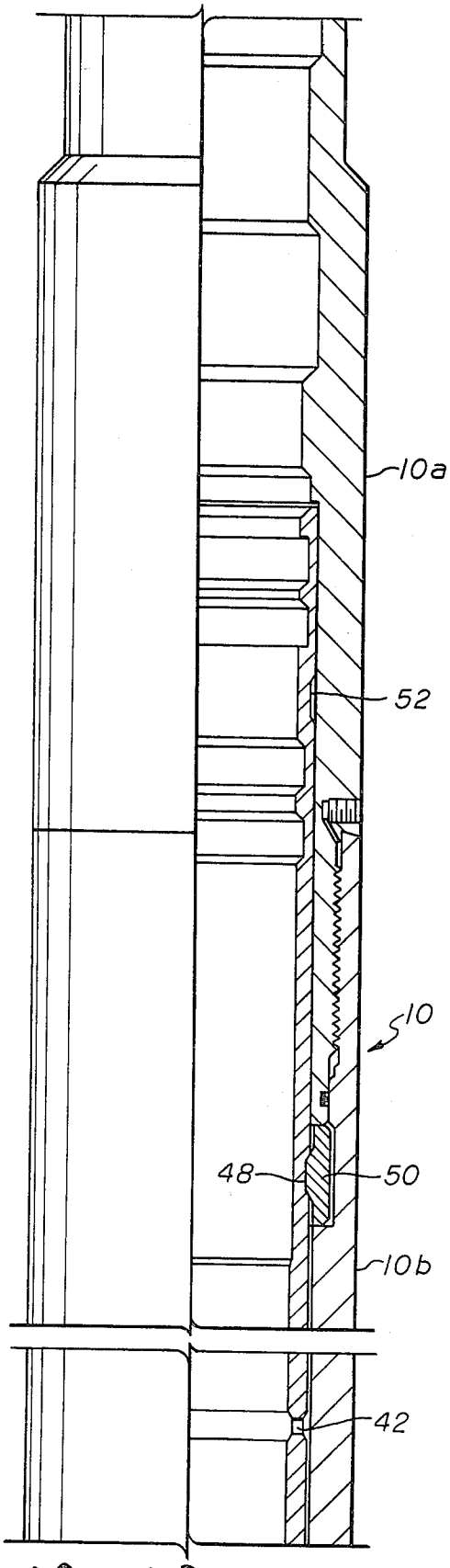
FIGS. 1A–B are elevational drawings, partly in cross section, illustrating the landing nipple of the invention.
Figure 1B:
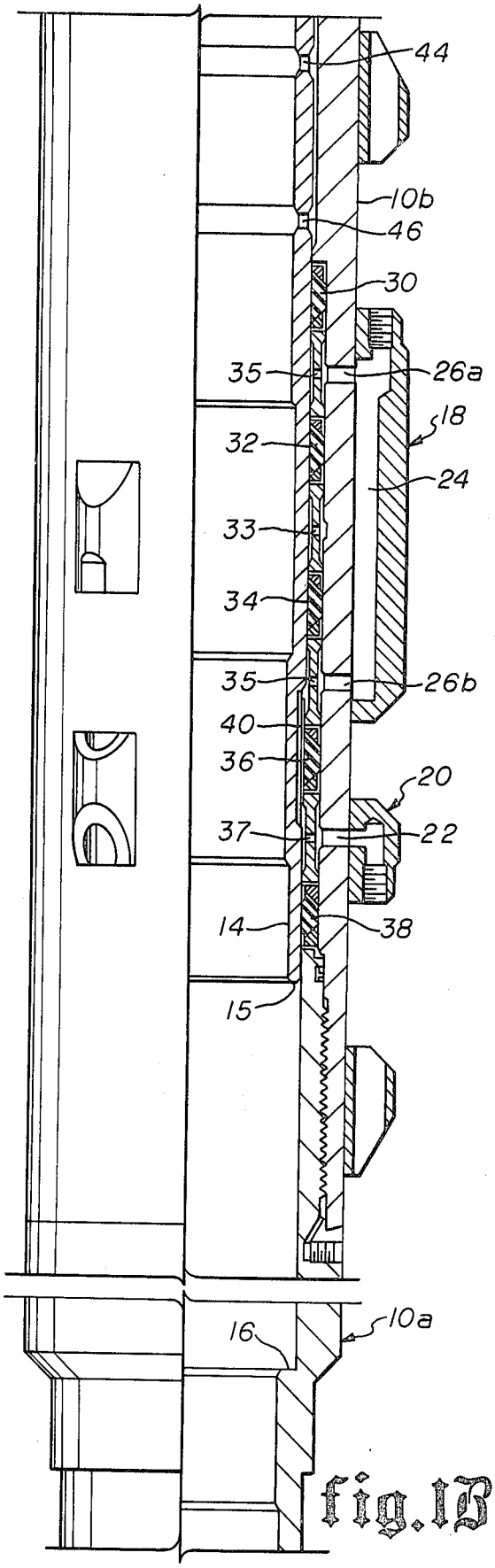

Referring to the drawings it can be seen that the landing nipple 10 illustrated in FIGS. 1 and 2 comprises three principal sections, the main nipple section 10b, lower sub-assembly 10a and upper sub-assembly 10c. The main nipple assembly 10b is provided with means for communicating control and balance pressure fluids into the nipple 10. These pressure fluids are conducted to the nipple 10 by conduits (not shown) extending from the well surface.

The principal objects of the invention are accomplished by the provision of balance pressure fluid passageways 26a and 26b which provide protection for the control pressure fluid entry port 28. That is to say, the seals 30, 32, 34 and 36 provide extra protection against the inadvertent admission of tubing bore pressure entering the control pressure fluid passageway 28.

When made up in a tubing string, the landing nipple of the present invention would normally be made up above a tubing retrievable safety valve. That is, a safety valve which is a component part of the tubing string, such as illustrated in U.S. Pat. application Ser. No. 960,170, filed concurrently with this application. Thus, in the event there was a malfunction in the tubing retrievable safety valve, an auxiliary safety valve 80 could be landed in the landing nipple 10 of this invention, providing a backup safety system in the tubing string. This would eliminate the danger of having an unobstructed tubing bore to the producing zone which, absent the landing nipple 10 of the present invention, would require pulling of the entire tubing string in order to provide a safety valve in the string. The auxiliary safety valve 80 is sometimes referred to herein using the general expression "flow control device", which means a valve or device for controlling flow of production fluids through the tubing and nipple bore passageway 12.

With the landing nipple 10 made up in the string above the tubing retrievable safety valve, control and balance fluid is conducted through conduits on the outside of the nipple and tubing string down to the tubing retrievable safety valve. In discussing "control" and "balance" fluid, those terms have their normal meanings as is well known in the art. That is to say, control fluid is normally a hydraulic fluid that is conducted from a pressure manifold (not shown), located at the surface of a well under pressure through conduit terminating ultimately to provide the pressured hydraulic fluid to the actuator for the flow control device. When pressure is applied to the actuator the safety valve flow control device is opened to flow production fluids, as will be discussed in detail hereinafter relative to the safety valve 80 landed in the landing nipple 10. "Balance fluid" is generally hydralic fluid placed in a separate conduit extending from the surface of the well to the safety valve, which acts to offset or "balance" the hydrostatic head of the column of "control" fluid. The balance fluid normally acts on the actuator to cancel the effect of the hydrostatic head of control fluid, as will be explained in more detail hereafter. In FIG. 1 it can be seen that balance fluid is conducted through passageway 24 through a passageway 26b and entry port 35 in the nipple 10, through passageway 40 thence through exit port 37 and passageway 22 and through conduit (not shown) to the tubing retrievable safety valve. In other words, the landing nipple forms a "T" flow path for conducting balance fluid from the well surface to the tubing retrievable safety valve. When it is desired to abandon use of the tubing retrievable safety valve, the means for communicating balance fluid to the lower safety valve is interrupted at the nipple.

In the embodiment of the invention illustrated in the drawings, control fluid is conducted first to the tubing retrievable safety valve and then circulated back to the landing nipple of the invention. This is done in order to maintain the closure means of the tubing retrievable safety valve in the "open" position. This is especially important in TFL operations in order to have a flow of fluids (and pressure) up the tubing string so that pump down equipment in the tubing can be retrieved. Control fluid is received in the nipple through conduit (not shown) which terminates at weldment 134, and enters the nipple through passageway 28.

Figure 2A:
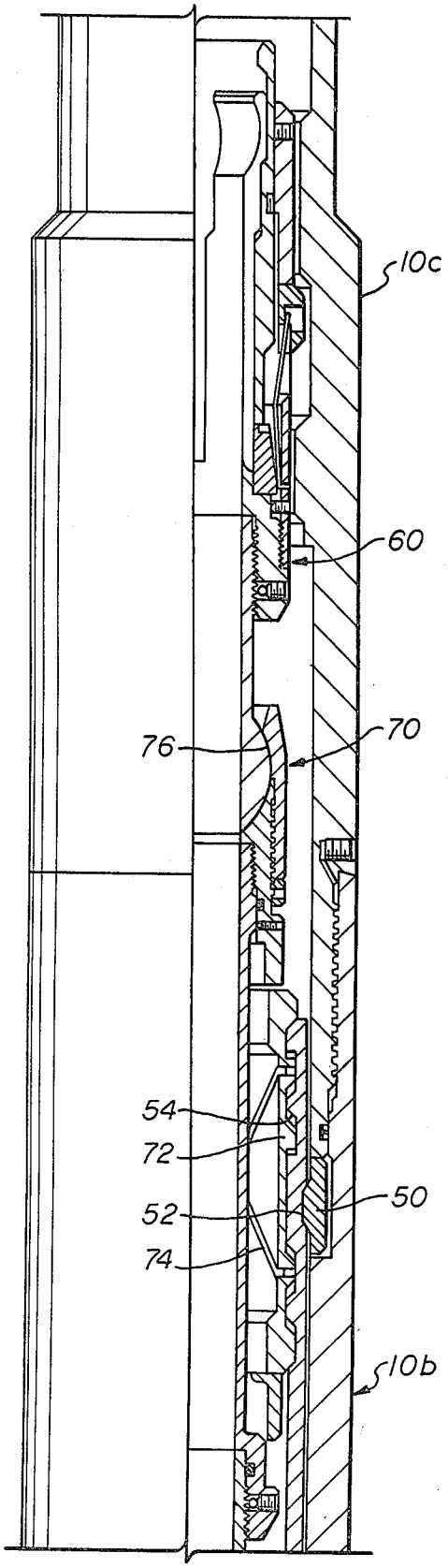
FIGS. 2A–B are elevational drawings, partly in cross section, illustrating the landing nipple of the invention, with a pump down flow control device landing in the nipple.
Figure 2B:
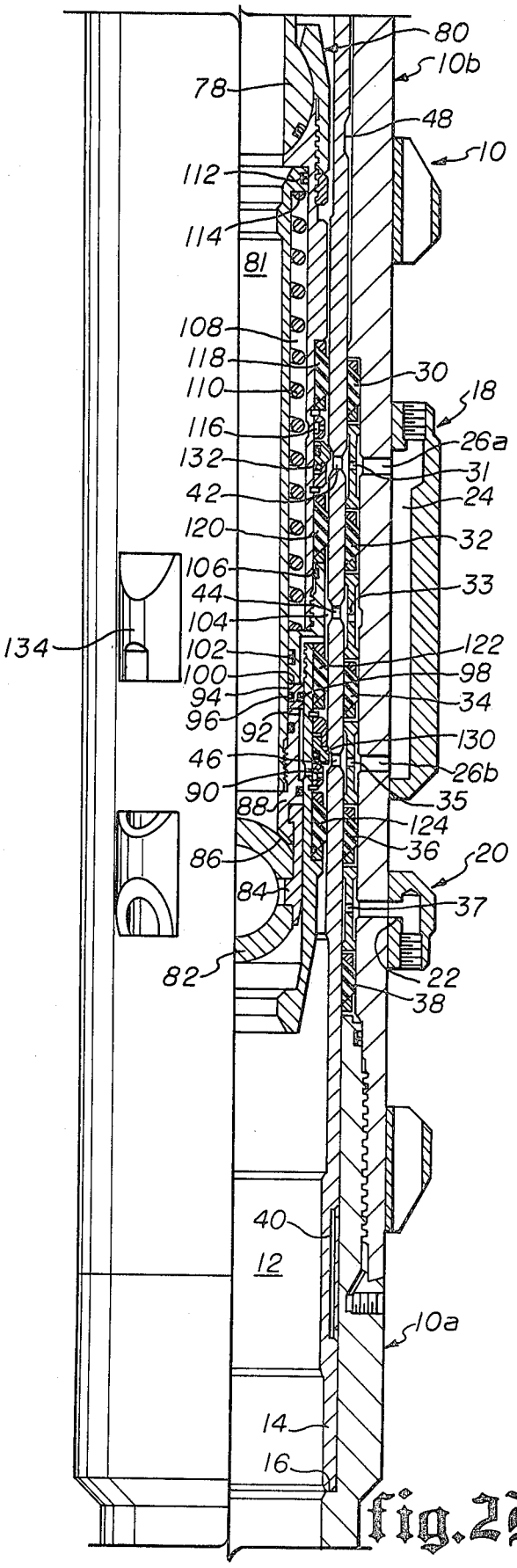

When it is desired to take the tubing retrievable safety valve out of service, the landing nipple of the invention is used to land and retain the secondary flow control device 80, as illustrated in FIGS. 2A and 2B. Balance and control fluid pressure is then directed to the nipple for operation of the flow control device 80 landed therein.

In order to accomplish this a sleeve 14 is positioned within the landing nipple. The sleeve 14 is axially movable within the nipple in order to align sleeve ports 42, 44 and 46 with nipple housing ports 31 and 33 and 35, respectively, as shown in the drawing. These ports are aligned when the sleeve 14 is shifted downwardly so that the lower end 15 of the sleeve abuts shoulder 16 of the landing nipple 10.

When the sleeve 14 is disposed upwardly, in the unshifted position, an annular passage 40 communicates between passageway 26b, entry port 35 and exit port 37. It is seen, then that in the downwardly shifted position, communication of balance fluid between passageway 26b and entry port 35 is blocked from reaching the tubing retrievable safety valve by the seal 36 being interposed between entry port 35 and exit port 37.

In a preferred embodiment of the invention, the balance pressure fluid entry ports 31 and 35 are positioned between well pressure in tubing bore 12 and control pressure fluid entry port 33. Seals 30 and 38 prevent well pressure from entering the balance fluid entry port 31 and 37, respectively, since these seals 30 and 38 are interposed between the entry ports 31 and 37 and well pressure.

The control fluid entry port 33 is isolated from balance fluid entry ports 31 and 35 by seals 32 and 34.

The landing nipple 10 of this invention reduces the possibility of well bore fluids entering the control chamber through the control passageway 28. As described above, seals 30, 32, 34 and 38 provide a means whereby leaking well fluids bypassing seals 30 and 38 would enter balance pressure fluid ports 31 and 37. Seal 38 provides sealing protection against well bore pressure entering balance fluid exit port 37 and passageway 22. Once the sleeve 14 is shifted to its lower position, as in FIG. 2, balance fluid is no longer transmitted to passageway 22. Seal 38 provides additional protection for balance entry port 35. Thus, if these seals were to fail, the well fluids would cause contamination of the balance fluids but would not interfere with the control function of the control line which maintains the safety valve in the open position. It could be said that the present invention provides for a "failed closed" safety valve. This is accomplished by the fact that if bore fluids of a pressure higher than control pressure were to enter the balance lines as described, control pressure would be exceeded by pressure in the balance pressure system and the safety valve would close. As long as control pressure fluid entering port 28 was the greater force being exerted on the safety valve, the safety valve would remain open. By having guard seals and balance pressure fluid ports on either side of the control port 28, the likelihood of a failed open safety valve is greatly diminished. A second line of safety is provided by seals 32 and 34 which provide a sealing function between the balance pressure fluid ports 31 and 35 and control pressure port 33.

The sleeve is retained in its position shifted downwardly by ring 50 being engaged in sleeve detent 52. When the sleeve 14 is shifted to its uppermost position the sleeve detent 48 is engaged by ring 50.

Sleeve 14 is normally in its uppermost position when nipple 10 is made up in the tubing string with the tubing retrievable safety valve and with the tubing retrievable safety valve being used as the primary flow control device for controlling well fluids. When sleeve 14 is in its upper position, there is no communication of balance fluid through the sleeve 14 to the nipple bore 12, as discussed above. However, in pump down (TFL) service, when it is desired to take the tubing retrievable safety valve out of service and then use an auxilary safety valve 80 landed in nipple 10, the auxiliary safety valve would normally carrying a shifting mandrel 70 as illustrated in the drawings. Keys 72 on the shifting mandrel 70 would engage a profile 54 on the inside surface of the shifting sleeve and the downward pressure exerted on the safety valve 80 would cause sleeve detent 48 to disengage from ring 50, shifting sleeve 14 down the lower end of sleeve 14 engaged shoulder 16 of nipple 10. As stated above, sleeve detent 52 should then be engaged by ring 50. The keys 72 of the shifting mandrel 70 are urged radially from the mandrel by the action of urging means 74. The urging means 74, as illustrated, are springs. Thus as the shifting mandrel 70 and safety valve 80 travel down the tubing bore, keys 72 are in their retracted position. As the shifting mandrel 70 enters sleeve 14 the keys and profile would match and the key 72 would engage therein securing the string of tools within the nipple 10.

The tool string illustrated in the drawings is known in the art as a pump down tool string and would normally comprise a locking mandrel 60, a shifting mandrel 70 and a safety valve 80. The individual tools in the tool string, as illustrated for the purpose of describing the present invention, are connected by ball joints 78 and 76. Pump down or through the flow line tools (TFL) are well known in the art and the manner of making up a tool string, such as illustrated, is well known to those practicing this art.

The pump down safety valve 80 illustrated in FIGS. 2A and 2B, is disclosed and claimed in U.S. Pat. No. 4,193,450 issued to Ernest P. Fisher, one of the co-inventors of this application. The pump down safety valve 80 is more fully described therein and such description is incorporated here by reference.

Figure 3:
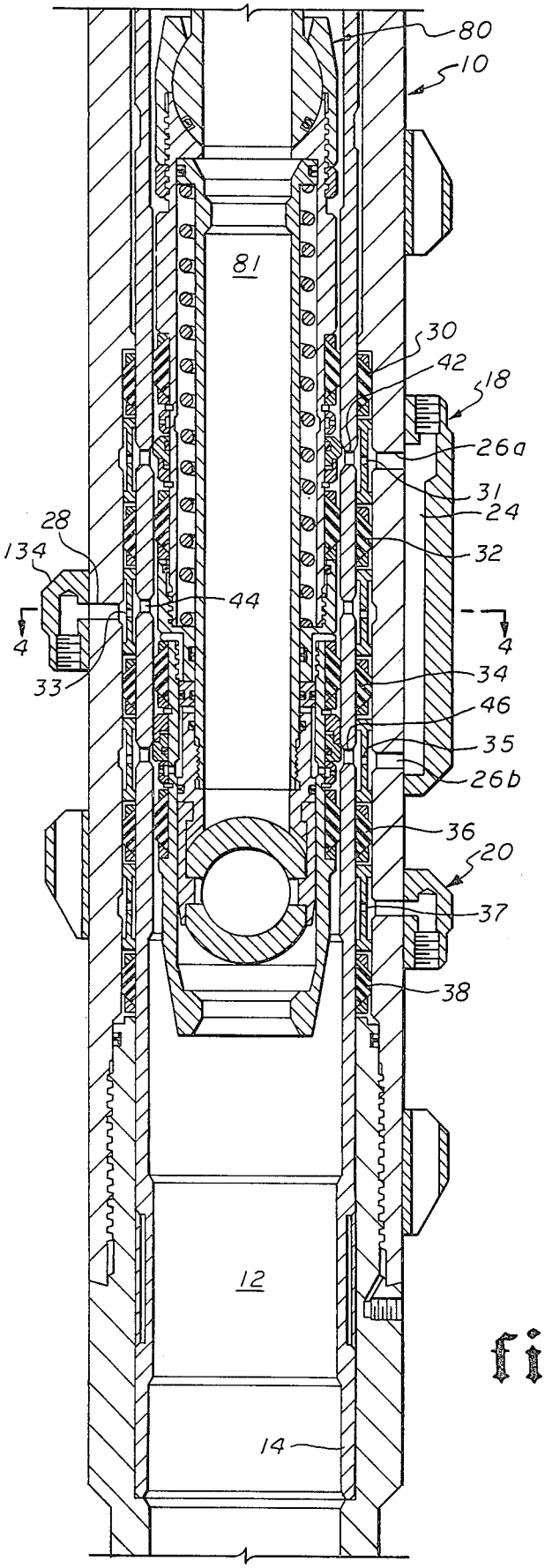
FIG. 3 is an elevational drawing, in cross-section, illustrating the landing nipple of the invention, with a pump down flow control device landed in the nipple.
Figure 4:
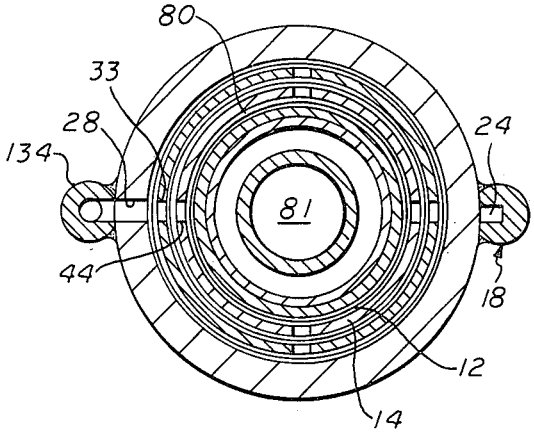
FIG. 4 is a cross-sectional view along the lines 4—4 of FIG. 3.

While FIGS. 2B and 3 of the drawings accompanying the present application illustrate a pump down or through-the-flow-line (TFL) safety valve the invention is equally applicable to a wire line set and retrievable safety valve. The safety valve 10 illustrated in FIGS. 2B and 3 is characterized by having a tubular housing 80 for defining a flow path through the bore 81 thereof. The valve closure means 82 for controlling flow through the bore 81, as illustrated in the drawings, is a ball rotatable between a bore closed position and a full bore open position. The ball 82 as illustrated is in the bore closed position. In the closed position, the ball 82 is seated upon a seat 86 which forms the lower end of an operator 83 which is longitudinally movable with respect to housing 80 for moving the closure member 82. The operator 83 has a first position wherein the closure member 82 closes the flow path through the bore 81 and has a second position where closure member 82 opens the flow path through bore 81.

The ball closure member 82 is rotatable about pin 84 in a manner that is well known in the art. Typical of the art relating to ball safety valves and mechanism for operating a ball closure member, such as used in the present invention, is U.S. Pat. No. 3,703,193 issued to George M. Raulins and assigned to Otis Engineering Corporation. The ball operation is also discussed in U.S. Application Ser. No. 794,410, filed May 6, 1977, by Thomas M. Deaton and assigned to Otis Engineering Corporation, now U.S. Pat. No. 4,140,153.

The operator tube 83 is responsive to control fluid pressure, which moves the operator tube to a second position wherein the bal closure member 82 is rotated to the full bore open position. Control fluid is conducted first to the landing nipple, as illustrated in FIG. 2, through entry ports in the landing nipple and then into a zone 104 which has access to a control fluid pressure chamber 100 in the safety valve. The zone for receiving control fluid 104 is the annular space between the outside of the safety valve and the inside bore wall of the landing nipple.

A balance fluid pressure chamber is positioned in the annular space between the operator tube 83 and the tubular housing member 80. Control pressure chamber 100 is isolated from the balance fluid pressure chamber in the valve by a seal member 102 on the inside diameter of the tubular housing 80b of the safety valve. The seal member 102, as illustrated in FIG. 2B, is known as a "T" seal, and seals between the operator tube 83 and the housing member 80b.

The balance pressure chamber 108 receives balance fluid from a source remote from the landing nipple in which the safety valve is housed. Balance fluid is conducted from a source at the surface of the well to the landing nipple and enters the balance fluid pressure chamber 108 via a passageway 26a, entry port 31 of the nipple, port 42 in the sliding sleeve 14 of the landing nipple, and then into an annular balance fluid zone existing between the safety vale and the bore wall of the landing nipple. Balance fluid would enter the safety valve through port means 116 on tubular subassembly 80c and enter the balance prssure chamber 108. Balance fluid would then be confined within the pressure chamber 108 by a T-seal 112, positioned on the upper end of the operator tube 83, sealing between the operator tube 83 and the inside surface of tubular housing member 80c. An upper shoulder 114 of the operator tube 83 is responsive to balance fluid in the balance fluid pressure chamber 108 , for assisting in closing ball member 82.

Balance fluid equalizes the effects of the hydrostatic pressure that exists due to the column of hydraulic fluid in control fluid conduit to the safety valve. Therefore, the balance pressure chamber, in equalizing the hydrostatic column of fluid to the surface of the well permits an urging means 110 to close the ball member 82. The urging means 110, in the present invention, is a helical spring disposed within the annular space 108 between the outside of the operator tube 83 and the inside of the housing member 80. The upper end of the spring 110 is engaged with a shoulder 114 of the operator 83. The lower end of the spring engages shoulder 115 of the housing 80b. The entry port 116 for admitting balance fluid into the valve is protected from exposure to well bore pressure by seals 118 and 120 which are positioned on either side of entry port 116 on the housing member 80c. An O-ring 106 in sealing contact between the junction of housing member 80b and 80c prevents balance fluid from entering the control fluid zone existing between seals 120 and 122, which seal the zone for control fluid when the safety valve is positioned in the landing nipple.

An additional zone within the valve is exposed to balance fluid pressure. This zone 92 is positioned between the control pressure chamber 100 and well bore pressure in order to provide additional protection against well bore pressure entering the control pressure chamber 100. The surface area of the balance fluid pressure exposed zone 92 is equal to the seal effective area of the control pressure chamber 100.

By seal effective is meant the surface area exposed to either control fluid pressure or balance fluid pressure within their respective zones as defined by means for sealing between the zones. The balance fluid pressure zone 92 is defined by seals 85, 96, 79 and 98 which seal against entry of tubing bore pressure or co-mingling of balance and control fluids as hereinafter described.

O-ring 96 provides a sealing relation between operator tube member 83 and extended portion 94 of the operator-seat member 88. O-ring 96 provides a seal between the balance fluid exposed zone 92 and the control fluid pressure chamber 100. In like manner, a T-seal member 98 provides a sealing protection between balance fluid and control fluid.

Balance fluid is supplied to the balance fluid exposed zone 92 in the following manner. Balance fluid from the landing nipple balance conduit 24 traverses passageway 26b entry port 35 in the landing nipple and then progresses through port 46 in the sliding zone 14 and furnishes balance fluid to an annular space between the safety valve and the landing nipple. Balance fluid is retained in this annular space by seals 122 and 124 of the safety valve which engage the walls of the nipple bore to provide a sealing relationship therebetween. Balance fluid then enters balance fluid exposed zone 92 through a port 90.

In the event seal 124 fails, tubing bore pressure escaping between the safety valve and the sleeve 14 would enter the annular space between seals 122 and 124 and progress through port 46, port 35, passageway 26b of the landing nipple and traverse passageway 24 and would invade the balance pressure chamber 108. Since tubing bore pressure plus pressure due to resilient means 110 normally exceeds the pressure being applied by control fluid in control fluid chamber 100, this would cause the operator tube 83 to be forced upwardly, which in turn would cause the safety valve ball member 82 to respond to the upward movement of operator tube 83 closing the safety valve. In a like manner the failure of seal 112, 118, 79, or 85 would close the safety valve. Should seal 120, 122, 102, 96, or 98 fail, the pressure in control fluid chamber 100 and balance pressure chamber 108 would equalize, allowing resilient means 110 to move operator tube 83 upwardly, causing ballmember 83 to close. It is this sequence of events that causes the present safety valve to be considered fail-closed in its mode of operation.

The balance fluid exposed zone 92 has a fixed capacity while balance fluid pressure chamber 108 has a variable capacity as does the control pressure chamber 100. Applying manifold pressure at the surface of the well to the control fluid conduit to the safety valve causes an expansion of the variable capacity control pressure chamber 100 which causes the operator tube 83 to be forced downwardly rotating ball member 82 to the full bore open position.

In the embodiment illustrated in FIGS. 2B and 3, the safety valve useful for pump down operations would normally carry wear rings 130 which are positioned on the outside of the safety valve housing member 80.

What is claimed is:

1. A landing nipple adapted to be made up in a tubing string comprising:

a tubular member having a bore extending axially therethrough adapted for receiving a flow control device in said bore, said tubular member having exterior means for receiving balance and control pressure fluids and means for communicating said fluids from the said exterior to the interior thereof, said means for communicating control pressure fluid being separated from well fluid pressure conducted through said tubing string by said means for communicating balance pressure fluid and seals therebetween, and additional seal means between said balance pressure fluid communicating means and said well fluid pressure conducted through said tubing string, whereby failure of said additional seal means causes said well fluid pressure to invade said balance pressure fluid communicating means rather than said control pressure communicating means.

2. The landing nipple of claim 1, wherein the tubular member has disposed in said bore a sleeve member axially movable between a first position and a second position, said sleeve having means for receiving a flow control device.

3. The landing nipple of claim 1, wherein the tubular member has disposed in said bore a sleeve member axially movable between a first position and a second position, said sleeve member having port means therein for providing communication from said tubular communicating means, for the control and balance pressure fluids, into the bore of said tubular member, said sleeve, when in its first position, preventing communication from said tubular communicating means, for the control and balance pressure fluids, into the bore of said tubular member.

4. The landing nipple of claim 1, wherein the tubular member has disposed in said bore a sleeve member axially movable between a first position and a second position, the sleeve member having port means therein for providing fluid communication from said tubular communicating means, for the control and balance pressure fluids, into the bore of said tubular member.

5. The landing nipple of claim 4, wherein said sleeve has means for receiving a flow control device, and said flow control device, when landed in said nipple, operates to shift said sleeve to its second position opening the ports means therein, whereby control pressure fluid and balance pressure fluid may be conducted to the bore of said tubular member.

6. The landing nipple of claim 5, wherein said flow control device operates to shift said sleeve to said first position closing the port means therein, whereby fluid communication of balance pressure fluid to the bore of said tubular member is terminated.

7. A landing nipple adapted to be made up in a tubing string above a tubing retrievable safety valve comprising a tubular member having a bore extending axially therethrough and having disposed in said bore a sleeve member movable between a first position and a second position in said bore and adapted for receiving a flow control device in said bore, said tubular member having exterior means fo receiving balance and control pressure fluids conducted from a source remote from said nipple and tubular port means for communicating said fluids from said exterior to the interior thereof, said communicating means for the control pressure fluid being separated from fluid pressure conducted through said tubing string by the communicating means for said balance pressure fluid and seals therebetween, and additional seal means between said balance pressure fluid communicating means and said fluid pressure conducted through said tubing string, whereby in the event said additional seal means fails said tubing fluid pressure would invade said balance pressure fluid communicating means in preference to said control pressure communicating means.

8. The landing nipple of claim 7, wherein the sleeve port means provides fluid communication from the exterior of said tubular member to the bore thereof when the sleeve is in its second position, and when said sleeve is in its first position seal means separate said sleeve port means from said tubular port means, whereby balance and control pressure fluids are prevented from being conducted to the bore of said tubular member.

9. The landing nipple of claim 7, wherein said sleeve is shiftable to its second position by a flow control device landed in said nipple.

10. The landing nipple of claim 7, wherein the sleeve member has port means therein for providing fluid communication from the exterior of said tubular member to the bore thereof, for conducting control and balance pressure fluids to the bore of said tubular member.

11. The landing nipple of claim 10, wherein the sleeve port means provides fluid communication from the exterior of said tubular member to the bore thereof when the sleeve is in its second position.

12. The landing nipple of claim 10, wherein the sleeve is shiftable to its second positon, whereby the sleeve port means provides fluid communication from the exterior of said tubular member to the bore thereof, and the means for conducting balance fluid to said tubing retrievable safety valve is interrupted.

* * * * *